United States Patent [19]

LaDue et al.

[11] Patent Number: 4,712,935

[45] Date of Patent: Dec. 15, 1987

[54] BLANK DOCUMENT GUARD IN A CHECK WRITING MACHINE

[75] Inventors: Philip G. LaDue; James D. Peglow, both of Canandaigua, N.Y.

[73] Assignee: The Standard Register Company, Dayton, Ohio

[21] Appl. No.: 794,985

[22] Filed: Nov. 4, 1985

[51] Int. Cl.[4] ..... B41J 13/10

[52] U.S. Cl. ..... 400/645.1; 400/642; 400/247

[58] Field of Search ..... 400/247, 248, 248.1, 400/248.2, 248.3, 642, 644, 647, 647.1, 645, 645.1, 645.2, 645.3, 645,4, 645.5

[56] References Cited

U.S. PATENT DOCUMENTS

| | | | |
|---|---|---|---|
| 1,260,170 | 3/1918 | Fanslow | 400/644 |
| 1,619,858 | 3/1927 | Gage | 400/644 |
| 3,035,680 | 5/1962 | Fondiller | 400/645.1 |
| 3,095,079 | 6/1963 | Morelli | 400/642 |
| 4,197,023 | 4/1980 | DeBoo et al. | 400/642 |
| 4,383,775 | 5/1983 | Trammell et al. | 400/248 |

FOREIGN PATENT DOCUMENTS

| | | | |
|---|---|---|---|
| 58902 | 9/1982 | European Pat. Off. | 400/247 |

*Primary Examiner*—Charles A. Pearson
*Assistant Examiner*—David A. Wiecking
*Attorney, Agent, or Firm*—Killworth, Gottman, Hagan & Schaeff

[57] ABSTRACT

A guard is used to close the gap between the print ribbon and a check supported by the platen in a check writing machine. The guard inhibits paper or metal shims from entering the gap to receive the check amount and payee data thereby protecting the printer from issuing blank checks which could later be filled out to create a counterfeit document.

9 Claims, 2 Drawing Figures

BLANK DOCUMENT GUARD IN A CHECK WRITING MACHINE

BACKGROUND OF THE INVENTION

A common technique used by dishonest persons to prepare counterfeit checks is to place a piece of paper between the printer ribbon and a blank check in a check printer. The printer is then allowed to enter the amount and the name of the payee onto the piece of paper. The date, signature and other authenticating data is printed on the check. The partially filled out check then exits the printer in the normal manner. The dishonest person can then take the check to a typewriter or to another check printer and fill out the check thereby preparing an authentic appearing counterfeit.

The guard of the present invention protects the blank checks by closing the gap between the printer ink ribbon cartridge and check. The leading edge of the guard is configured to apply a thin line of pressure to the face of the check which is too strong to be overcome by a piece of paper or a thin metal shim. The edges of the guard are tapered inwardly toward the center to prevent a paper or metal shim from being entered from the side.

DESCRIPTION OF THE INVENTION

Figure 1:
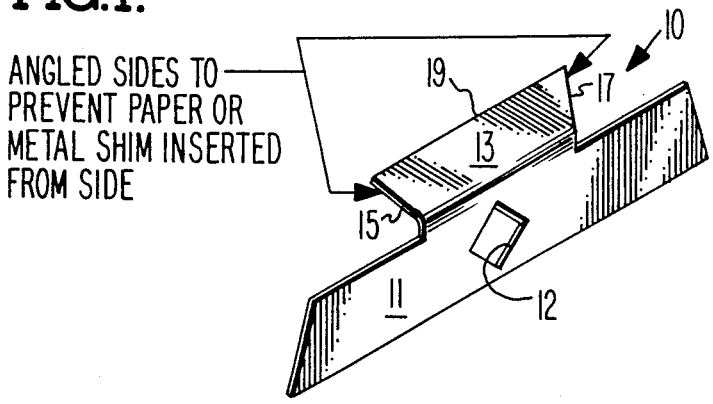
FIG. 1 is a perspective view of an embodiment of the guard.

The preferred embodiment of the guard of the present invention is shown in FIG. 1. The guard 10 has an elongated support portion 11 which is used to fasten the guard to a cartridge containing an ink ribbon. An ink aperture 12 is provided in the portion 11 to enable the ink ribbon to be driven therethrough under impact from the wires of a matrix printer. Extending from one edge of the elongated portion 11 is a tab like portion 13 having side portions 15 and 17 sloping inwardly from an outer edge 19. The tab portion 13 is bent out of the plane of the elongated central portion 11 at an angle greater than 90°.

Figure 2:
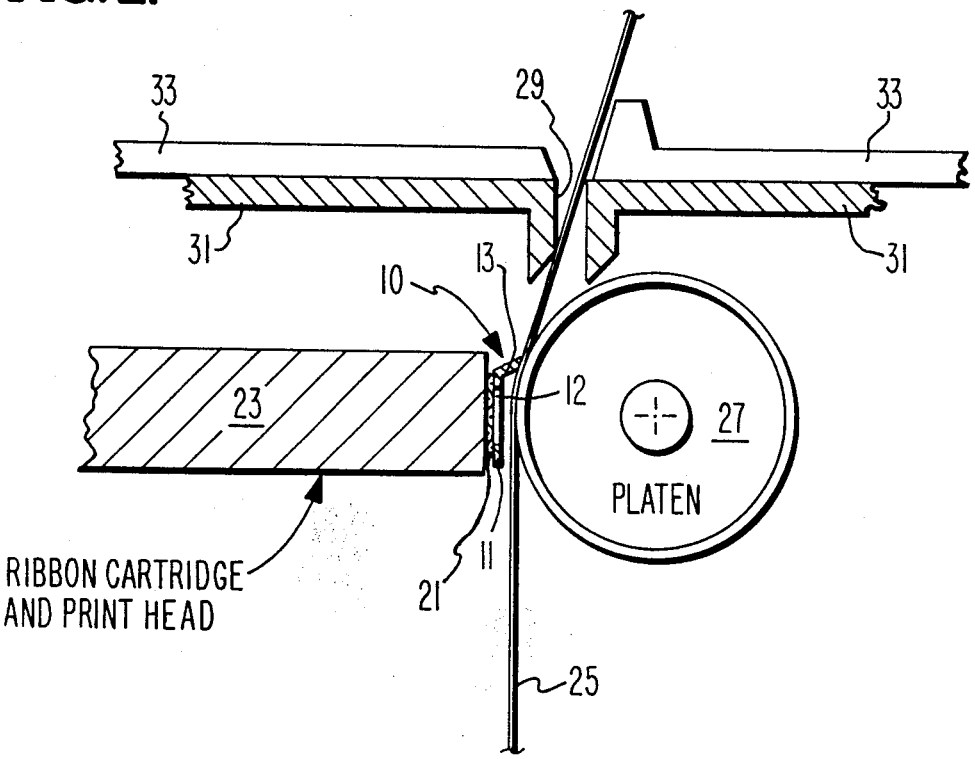
FIG. 2 is a side elevational schematic view showing the guard in place in a check printer.

The guard 10, referring to FIG. 2, is adapted to fasten to the front face 21 of a ribbon cartridge 23 with the edge 19 exerting pressure against a document 25, for example a check or money order. The document is supported against a platen 27 and within an elongated narrow document aperture 29 in a bezel 31 mounted below the cover 33 of the a check printer.

In the preferred embodiment the ends of the elongated portion 11 will snap in place behind bosses on the face of the cartridge containing the ink ribbon. The guard can also be attached to the face of the ink ribbon cartridge by any other suitable fastening means such as adhesive, plastic snaps, screws, etc.

The guard can be made out of any resilient material such as plastic or metal. The preferred material is a plastic such as polypropylene, polycarbonate or polyethylene terephthalate. The length and width of the guard depend on the type of ink ribbon cartridge used and the distance from the ribbon to the platen. The thickness of the material forming the guard should be approximately within the range 0.003 to 0.010 inch. The guard should be thick enough to exert pressure on a document and yet thin enough to enable the document to move. Also, if the guard is intended to snap in place on the face of the ink ribbon cartridge, it should be flexible. The same dimensional criteria apply if the part is made of metal.

The size and shape of the aperture in the guard is a function of the ink ribbon cartridge and the dot matrix printer with which it is to be used.

Referring to FIG. 2, if an attempt is made to put a piece of paper or a thin metal shim through the aperture 29 in the bezel 31 to enter the space between the print ribbon and the document, it can be seen that the guard 10 has closed off this space. The inserted paper would be directed away from the document down onto the top of the ink ribbon cartridge. If an attempt is made to enter the same space from the side by sliding a paper or metal shim across the face of a document, the tapering surfaces 15 and 17 of the guard 10, referring to FIG. 1, will direct the foreign object away from the document into the notch in the guard. It can be seen then that by using the guard of the present invention a check printer is protected from issuing blank documents.

What is claimed is:

1. A guard for use in a printer to inhibit the entry through a document aperture in said printer of extraneous print receiving media between an ink ribbon and a printer platen, said ink ribbon and said printer platen being positioned beneath said document aperture, comprising, support means adapted to be disposed on an ink ribbon containing cartridge and defining a ribbon aperture through which said ink ribbon may be driven, pressure means extending from said support means to said platen above said ribbon and adapted to bear against said printer platen along a line directly above said ribbon aperture, thereby closing the space between said ink ribbon and said printer platen.

2. The guard of claim 1 in which said pressure means comprises a tab having an upper edge bearing against said printer platen along said line, said tab further defining a pair of side portions which taper inwardly toward said support means so as to direct extraneous print receiving media away from said platen if an attempt is made to insert said media from the side between said upper edge and said platen.

3. A guard for use in a printer to inhibit the entry through a document aperture in said printer of extraneous print receiving media between an ink ribbon and a printer platen, said ink ribbon and said printer platen being positioned beneath said document aperture, comprising, support means adapted to be disposed on an ink ribbon containing cartridge and defining a ribbon aperture through which said ink ribbon may be driven, pressure means disposed on said support means and adapted to bear against said printer platen above said ribbon aperture, closing the space between said ink ribbon and said printer platen, said pressure means extending from said cartridge to said platen above said ribbon and defining a portion having an outer edge which bears against said printer platen continuously along a line above said ink aperture so as to preclude insertion of extraneous print receiving media through said document aperture and between said ink ribbon and said printer platen.

4. A guard as set forth in claim 3 wherein said support means comprises an elongated resilient member adapted to be mounted on an ink ribbon containing cartridge.

5. A guard as set forth in claim 3 wherein said pressure means is disposed at an angle to said elongated resilient member and adapted to close the gap between the ink ribbon and the printer platen.

6. A guard as set forth in claim 3 wherein said pressure means is unitarily formed with said support means.

7. A guard as set forth in claim 3 wherein said guard is made of plastic.

8. A guard as set forth in claim 3 wherein said guard is made of metal.

9. A guard as set forth in claim 3 wherein the sides of said pressure means flare outwardly from said support means to form a notch.

* * * * *